US011060721B2

(12) United States Patent
Kattelus et al.

(10) Patent No.: US 11,060,721 B2
(45) Date of Patent: Jul. 13, 2021

(54) BURNER AS WELL AS BOILER-BURNER ASSEMBLY AS WELL AS METHOD FOR GENERATING A FLAME INTO THE SAME

(71) Applicant: Oilon Technology Oy, Lahti (FI)

(72) Inventors: Joonas Kattelus, Lahti (FI); Lassi Karvonen, Vantaa (FI); Michele Danelon, Lahti (FI)

(73) Assignee: Oilon Technology Oy, Lahti (FI)

( * ) Notice: Subject to any disclaimer, the term of this patent is extended or adjusted under 35 U.S.C. 154(b) by 160 days.

(21) Appl. No.: 16/357,524

(22) Filed: Mar. 19, 2019

(65) Prior Publication Data

US 2020/0300461 A1 Sep. 24, 2020

(51) Int. Cl.

| | |
|---|---|
| ***F23D 14/02*** | (2006.01) |
| ***F23D 14/58*** | (2006.01) |
| ***F23D 14/62*** | (2006.01) |

(52) U.S. Cl.

CPC ..... *F23D 14/58* (2013.01); *F23D 14/02* (2013.01); *F23D 14/62* (2013.01)

(58) Field of Classification Search

CPC ..... F23D 14/58; F23D 14/02; F23D 14/62; A47J 36/321

USPC ..... 431/354; 426/231

See application file for complete search history.

(56) References Cited

U.S. PATENT DOCUMENTS

| | | | | |
|---|---|---|---|---|
| 2,390,059 | A * | 12/1945 | De Lancey | F23D 5/045 431/10 |
| 6,238,206 | B1 | 5/2001 | Cummings, III et al. | |
| 8,784,096 | B2 * | 7/2014 | Mosiewicz | F23C 5/08 431/174 |
| 2012/0003595 | A1 | 1/2012 | Goh et al. | |

FOREIGN PATENT DOCUMENTS

| | | | |
|---|---|---|---|
| CN | 106949471 | A | 7/2017 |
| DE | 19521844 | A1 | 1/1996 |

* cited by examiner

*Primary Examiner* — Avinash A Savani

(74) *Attorney, Agent, or Firm* — MacMillan, Sobanski & Todd, LLC

(57) ABSTRACT

The invention relates to a burner installable to a boiler for burning a premixed air-fuel mixture, said burner comprising a frame member provided with an elongated combustion head protruding from the frame member and having what in a view from the frame member is its distal end provided with a tip plate. In said burner between a side edge of the tip plate and the plane of the tip plate is an oblique angle of incidence for directing a gas delivered forward of the tip plate away from the longitudinal center axis of the combustion head, the combustion head has its tip plate provided with a plurality of air openings extending through the tip plate and it is for cooling the tip plate that the inner tube is additionally provided with a supply of combustion air for conveying the combustion air through the tip plate's air openings.

25 Claims, 6 Drawing Sheets

BURNER AS WELL AS BOILER-BURNER ASSEMBLY AS WELL AS METHOD FOR GENERATING A FLAME INTO THE SAME

FIELD OF THE INVENTION

The invention relates to a burner installable to a boiler for burning a premixed air-fuel mixture capable of being installed in a boiler for burning a premixed air-fuel mixture.

The invention relates also to a boiler-burner assembly for burning a premixed air-fuel mixture with a flame generated inside a boiler for burning a premixed air-fuel mixture and a method for generating a flame into the boiler-burner assembly.

BACKGROUND

So-called premix burners are used for burning a mixture of premixed fuel and air. These burners are intended to attain low NOx emission levels. Particularly premix burners with a long combustion head, intended for attaining low NOx emissions (less than 9 ppm NOx emissions in flue gases) without substantial residual oxygen, are disclosed in the prior art, i.a. in the publication U.S. Pat. No. 6,238,206. This prior known burner model is provided with a combustion head associated with the frame and extending a long way into the interior of a boiler. The biggest downside of this burner has nevertheless been found to be a continuously relatively high NOx emission level, not completely fulfilling the stringent emission standards of e.g. certain states in the United States provided that the burner is to be operated efficiently, in other words, with residual oxygen of less than 3%. Another weakness in relation to the discussed prior known premix burner is its limited compatibility with commercially available boilers.

SUMMARY OF THE INVENTION

The invention is intended to provide an improvement regarding the foregoing prior art or at least to alleviate the drawbacks existing in the above-described prior art. Therefore, a first objective of the invention is to provide a high-efficiency burner installable to a boiler, as well as a boiler-burner assembly in which a premixed air-fuel mixture can be combusted by the burner with low residual oxygen of less than 3% in such a way that the average NOx emissions in flue gases remain below 15 ppm, and with residual oxygen of less than 6% in such a way that the average NOx emissions in flue gases remain below 5 ppm. A second objective of the invention is to provide a burner more readily installable to commercially available boilers, as well as a boiler-burner assembly obtainable thereby.

The above objectives will be attained with a burner according to the claims capable of being installed to a boiler for burning a premixed air-fuel mixture, as well as with a boiler-burner assembly according to the claims for burning a premixed air-fuel mixture More specifically, the invention relates to a burner installable to a boiler for burning a premixed air-fuel mixture. The burner comprises a frame member provided with an elongated combustion head protruding from the frame member. What in a view from the frame member is a distal end of the combustion head is provided with a tip plate and the combustion head comprises an outer, larger diameter tube for a mixture of combustion air and fuel, as well as an inner, smaller diameter tube for combustion air. The combustion head has its outer tube formed with at least one array of aperture lines encircling said body of the outer tube and, in addition, what in a view from the burner's frame member is a distal end opening of the outer tube, i.e. a tip opening of the outer tube, opens to below the tip plate. Said outer tube is provided with a supply of premixed air-fuel mixture from the burner's frame member for conveying the premixed air-fuel mixture outward of the combustion head by way of the apertures included in the body of the outer tube, as well as by way of the outer tube's tip opening, and the inner tube of the combustion head is continuous and extends from the frame member forward of the tip plate. The tip plate has a width substantially equal to the diameter of the outer tube's tip opening and the direction of a plane defined by the tip plate is transverse to a longitudinal direction of the combustion head. In the invention, between a side edge of the tip plate and the plane of the tip plate is an oblique angle of incidence for directing a gas delivered forward of the tip plate away from the longitudinal center axis of the combustion head, and the combustion head has its tip plate provided with a plurality of air openings extending through the tip plate and it is for cooling the tip plate that the inner tube is additionally provided with a supply of combustion air for conveying the combustion air through the tip plate's air openings.

On the other hand, in a boiler-burner assembly of the invention for burning a premixed air-fuel mixture with a flame generated inside a boiler, the burner comprises a frame member remaining outside the boiler and has associated therewith an elongated combustion head protruding from said frame member. The combustion head has its first section remaining outside the boiler or connected to structures of the boiler and the combustion head has its second section extending into an interior of the boiler. What in a view from the frame member of the burner is a distal end of the combustion head is provided with a tip plate, said combustion head comprising an outer, larger diameter tube for a mixture of combustion air and fuel as well as an inner, smaller diameter tube. Hence, the combustion head has its outer tube formed with at least one array of aperture lines encircling said body of the outer tube and, in addition, what in a view from the burner's frame member is a distal end opening of the outer tube, i.e. a tip opening of the outer tube, opens forward of the tip plate. The outer tube is provided with a supply of premixed air-fuel mixture from the burner's frame member for conveying the premixed air-fuel mixture outward of the combustion head by way of the apertures included in the body of the outer tube as well as the outer tube's tip opening, and the inner tube of the combustion head is continuous and extends from the frame member forward of the tip plate, said tip plate having a width substantially equal to the diameter of the outer tube's tip opening and the direction of a plane (R) defined by the tip plate is transverse to a longitudinal direction (P) of the combustion head. In the invention, from the burner's frame member is provided a supply of combustion air into the combustion head's inner tube for conveying the combustion air by way of said inner tube to what in a view from the burner's frame member is a forward side of the tip plate and further through air openings included in the tip plate for cooling said tip plate. Consequently, the temperature of a flame portion generated inside the boiler, which temperature is established in the boiler interior immediately behind the tip plate, is lower than the temperature of a main flame surrounding the same, the combustion head has its tip plate located at such a distance from the outer tube's mouth that the gas arriving on a forward side of the tip plate has a flow connection from the forward side of the tip plate into an interior of the boiler and, in addition, between a side edge of the tip plate and a rear surface of the tip plate is an angle of incidence as a result of which the gas supplied to the forward side of the tip plate is directed angularly away from the longitudinal center axis of the combustion head.

In the method of the present invention combustion air is arranged to flow from the combustion head's inner tube to a forward side of the tip plate and further through air openings included in the tip plate for cooling said tip plate, whereby the temperature of a flame portion generated inside the boiler, which temperature is established in the boiler interior immediately behind the tip plate, is lower than the temperature of a main flame surrounding the same. Additionally the gas, such as the fuel-air mixture, supplied in a space on a forward side of the tip plate is arranged to be in a flow connection from the space on the forward side of the tip plate into an interior of the boiler and is directed angularly away from a longitudinal center line of the combustion head by means of an angle of incidence between a side edge of the tip plate and a plane defined by the tip plate, thus generating a main flame which surrounds said flame portion said main flame having a conical burning zone at a tip of the combustion head.

With the definition "the tip plate has a width substantially equal to the diameter of the outer tube's tip opening" is meant in this connection, that the width of the tip plate may about the same or slightly bigger or slightly smaller than the width of the tip opening of the outer tube.

The plane R of a tip plate is perceived as a plane extending across the tip plate's center axis and extending in a lengthwise direction of the tip plate.

In one preferred embodiment of the invention, the tip plate has its side edge at an angle of about 40-80 degrees, specifically at an angle of 60 degrees, with a plane defined by the tip plate in a view of the tip plate from the burner's frame member.

As a result, the air-fuel mixture discharging from the outer tube's mouth is directed away from the combustion head's longitudinal center axis at an angle of about 40-80 degrees, especially at an angle of 60 degrees, in a view of the flow from the burner's frame member.

In another preferred embodiment of the invention, the combustion head has its outer tube formed with a first plurality of apertures, for example a plurality of apertures with a circular cross-section. This plurality of apertures consists of a line of apertures with the apertures included therein encircling the outer tube in the proximity of what is its distal end in view from the burner's frame. In addition, the combustion head is formed with a second plurality of apertures consisting of apertures with an elongated or oblong cross-section, such as apertures with a cross-section in oval or elliptical shape, said second plurality of apertures being made up of a line of apertures with the apertures included therein encircling the outer tube preferably in its mid-section.

Thus, it is preferably in connection with the combustion head's outer tube that mechanical adjustment elements are provided for adjusting the size of apertures included in the outer tube's walls.

The present invention is first of all based on a combustion head being constructed of two concentric tubes, and the inner tube is supplied with cooling air which flows from the inner tube forward of a tip plate and further through air openings included in the tip plate. This cools down the tip plate while on a rear side of the tip plate is established a side flame C (subsequently also a flame portion), said side flame having a temperature which is lower than that of a main flame B which is adjoined by said side flame C.

In case the inner tube is supplied with electric wires, the cooling of a tip plate achieves a significant benefit in the sense that the tip plate cooling also protects the electric wires extending within the inner tube from excessive heating.

Secondly, the invention is based on having between a side edge of the tip plate and a front surface of the tip plate an oblique angle of incidence, especially an angle of 40-80 degrees. Consequently, the air-fuel mixture delivered to a forward side of the tip plate by way of the outer tube is directed at an angle, preferably at an angle of about 60 degrees, forward and away from a longitudinal center axis of the combustion head in a view of the gas flow from the burner's frame member.

It is by directing the air-fuel mixture in such a way that the tip of a combustion head (rearward of a plane R approximately defined by the tip plate) is provided with an advantageous, large-volume main flame B in a hollow cone shape. It is a large volume of the main flame B that achieves a low temperature for the main flame and reduces NOx emissions remarkably. Additionally, it is a conical shape of the main flame that enhances intra-boiler return flows, which further expand the main flame volume and reduce NOx emissions.

In case the boiler has outlet ports for flue gases on the rearward side of what in a view from the burner's frame member is a plane defined by the tip plate, immediately behind a flame portion C, present on the rear side of the tip plate, will be generated a flame portion D with powerful return flows of flue gas being directed therefrom e.g. into zones of the main flame B and the side flame C. The discussed return flows of flue gas are generated e.g. by a shape of the flame as well as by an inclined position of the flame plate's side edges with respect to a front surface of the flame plate. It is by virtue of the return flows of flue gas that carbon monoxide emissions within a zone of the flame portion D burn out with high efficiency.

Thirdly, the invention is based on having the outer tube of a combustion head formed with a first array of apertures, for example apertures with a circular cross-section. In addition, the combustion head is formed with a second array of apertures consisting preferably of apertures with an elongated cross-section, such as apertures with cross-sections in oval or elliptical shape. The air-fuel mixture, delivered from the first and second lines of apertures around the combustion head, increases the temperature of a flame portion A generated around the combustion head and simultaneously stabilizes this particular flame portion.

In a preferred embodiment of the invention, the outer tube is provided with mechanical adjustment elements capable of being used for configuring the size of elongated apertures included in the outer tube's walls, thereby providing a capability of configuring the temperature of the combustion head-surrounding flame portion A so as to make it appropriate for each boiler.

The invention and benefits attained thereby will now be illustrated in even more detail with reference to the accompanying drawings.

DETAILED DESCRIPTION

The general construction of a burner 1 is depicted in FIGS. 1-5.

Figure 1:
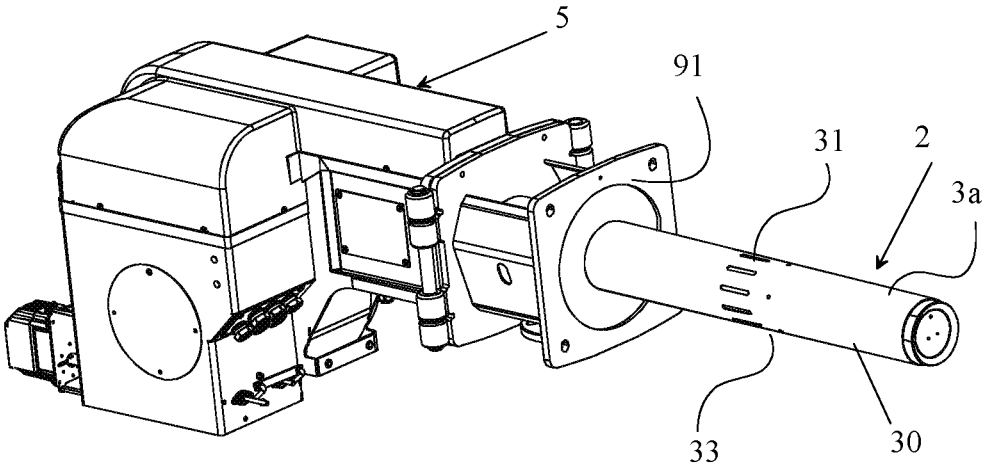
FIG. 1 shows a burner's frame member, as well as a combustion head associated therewith, in a perspective view.

Of these, FIG. 1 shows in its entirety, in a view from outside, a burner 1 of the invention which is capable of being installed to a boiler 9.

Figure 2:
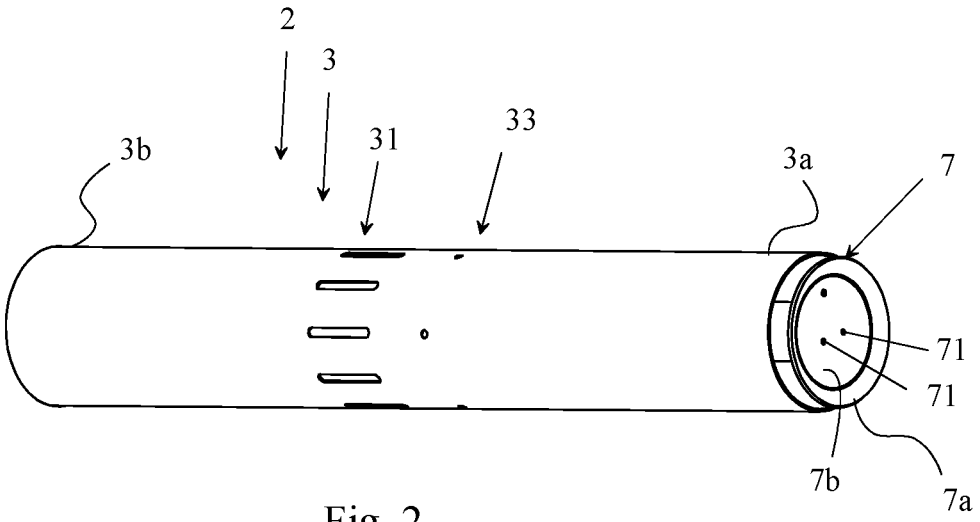
FIG. 2 shows a combustion head for the burner of FIG. 1 in a slightly inclined front and side view.

FIG. 2 discloses details of an outer tube 3 for a combustion head 2 of the burner, which details remain inside a boiler as the burner is installed. The combustion head 2 has a body of its outer tube 3 provided with two arrays of aperture lines 31, 33 encircling said body 30 of the outer tube 3 and visible also in FIGS. 1, 3A, 4 and 5.

As seen from FIGS. 1 and 2, the burner 1 comprises a combustion head 2 associated with a frame member 5. The burner 1 is installable to a boiler by means of a flange 91. What in a view from the frame member 5 of the burner 1 is an outer end of the combustion head 2 is provided with a tip plate 7.

Figure 3A:
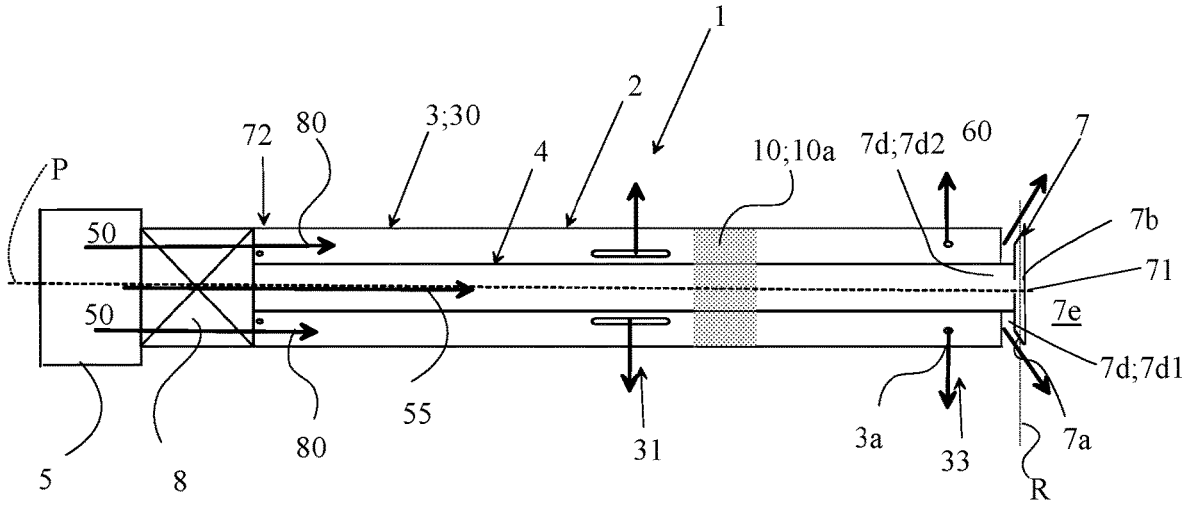
FIG. 3A shows, in a schematic longitudinal section view, a combustion head for a burner of the invention, and a burner frame member associated therewith.

Visible in a longitudinal section view of FIG. 3A is a combustion head 2 for the burner 1, as well as some of the burner's frame member 5 as illustrated in the longitudinal section view. The figure reveals an outer tube 3 of the combustion head 2, as well as a smaller diameter, inner tube 4 present completely inside the outer tube 3.

The actual combustion head 2 comprises an outer, larger diameter tube 3, and a smaller diameter, inner tube 4 more clearly visible in section FIGS. 3-5, which extends in its entirety inside the outer tube 3. The inner tube 4 of the combustion head 2 has a body which is continuous, uniform, and extends in a view from the frame member 5 to a forward side 7*d*; 7*d*2 of a tip plate 7 and connects all the way to a front surface 7*c* of the tip plate. Hence, at a junction of the inner tube, the outer tube and the tip plate, on a forward side 7*d* of the tip plate 7 (in a view from the frame member 5), is established a first space 7*d*2.

The inner tube 4 is intended for combustion air and is used in a subsequently described manner (cf. FIGS. 3A and 3B) for preventing the temperature of a tip plate 7 mounted to the boiler 1, as well as that of a flame portion C present behind the tip plate, from becoming excessively high.

The outer tube, in turn, has its mouth 35 opening into a second space 7*d*1 on the forward side 7*d* of the tip plate 7. Blending of gas flows 55, 80 arriving in the first space 7*d*2 and the second space 7*d*1 on the forward side 7*d* of the tip plate 7 is prevented as the inner tube 4 extends all the way to the tip plate's front surface 7*c*.

The tip plate 7 has width T which is roughly equal to a diameter of the outer tube's 3 tip opening 35 in the direction of a plane R defined by the tip plate 7. The direction of the tip plate's R plane is transverse to a lengthwise direction P of the combustion head.

The combustion head 2 has a body of its outer tube 3 provided with two arrays of aperture lines 31, 33 encircling said body 30 of the outer tube 3, whereof the apertures included in the aperture line 31 are elongated in shape, cf. also FIGS. 1, 2, 4A, 5A.

A second array of apertures formed in the combustion head 2 consists of apertures with an elongated cross-section, such as apertures with oval and/or ellipse-shaped cross-sections extending through the body 30 of the tube 3. This plurality of apertures is made up of an aperture line 31 with the apertures included therein encircling the tube 3 in its mid-section or middle region at an equal distance from a distal end 3*a* of the outer tube 3 in a view from the burner's frame member 5.

FIG. 3A reveals also mechanical adjustment elements 10 provided in connection with the outer tube 3 of the combustion head 2 for adjusting opening sizes of the elliptical apertures 31 included in the outer tube's 3 walls. The mechanical adjustment elements comprise in this case a flange element present on the outer tube's internal surface, especially a collar 10*a*, which is displaceable to cover partially or completely the elongated apertures of the aperture line 31. The collar 10*a* enables adaptation of a fuel-air mixture 40 flowing from the apertures of the aperture line 31 to become appropriate for each boiler size and shape so as to enable optimization of the temperature of a flame portion A formed around the combustion head 2 in a subsequently described manner.

Figure 3B:
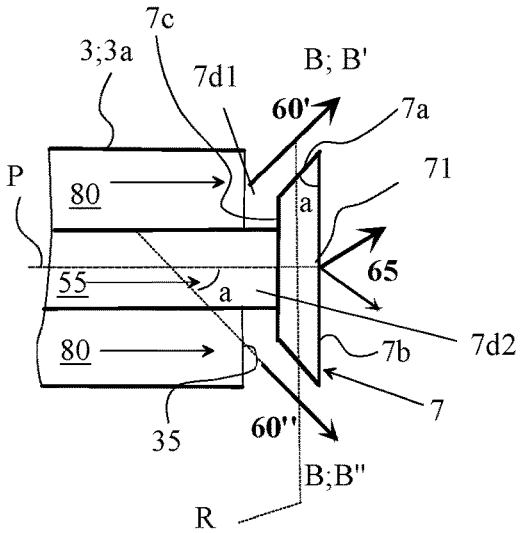
FIG. 3B shows in more detail a tip plate region visible in FIG. 3A.

FIG. 3B reveals, likewise in a longitudinal section view and in more detail, a region around the tip plate 7 of the combustion head 2 visible in FIG. 3A. As a result of structural features of the tip plate 7 there is generated a main flame B, as well as a side flame C developing immediately behind the tip plate 7, on a rearward side 7*c*.

The tip plate 7 signifies a so-called flame plate, which is used for spreading a mixture 80 of combustion air and fuel, arriving from a tip 3*a* of the larger tube 3, into the boiler 9. In addition the tip plate 7 can be used for protecting electric wires extending within the inner tube 4 from excessive heating.

Therefore, the tip plate 7 is firstly provided with a plurality of air openings 71 extending through the tip plate 7 and, in addition, the inner tube 4 has its mouth opening in the traveling direction of combustion air 55 immediately onto a forward side 7; 7*d*2 of the tip plate 7 into alignment with the air openings 71 extending through the tip plate 7. Inside the inner tube 4 is a space for example for electrification.

It is for cooling the tip plate 7 that the inner tube 4 is provided with a supply of combustion air 55 from the burner's 1 frame member 5 for conveying the combustion air 55 onto a forward side 7; 7*d*2 of the tip plate 7 and further through the air openings 71 onto a rearward side 7*e* of the tip plate. By cooling the tip plate 7 it is possible to install for example electrical wirings (not shown in the figures) inside the inner tube. Electrification cannot be carried out this way in prior known burners.

The tip plate 7 is disposed at such a distance lengthwise P of the combustion head 2 from the mouth 35 of the outer tube 3 that the air-fuel mixture 80, arriving by way of the outer tube 3 in a second space 7*d*; 7*d*1 present on a forward side 7*d* of the tip plate's 7 front surface 7*c*, shall flow from the space 7*d*; 7*d*1 present on a forward side of the tip plate 7 in a flow co-directional with a side edge 7*a* of the tip plate over onto the other side of a plane R of the tip plate. Between the tip plate's 7 side edge 7*a* and the tip plate's 7 rear surface 7*b* is an angle of incidence a. The mixture of fuel and gas, preferably a fuel and air mixture 60, delivered from the outer tube into the space 7*d*1 on a forward side of the tip plate 7, proceeds along the side edge 7*a* of the tip plate 7. Since there is the angle of incidence a between the tip plate's side edge 7 and the tip plate's rear surface 7*b*, it is also in an inclined orientation that the fuel and air mixture 60 comes across the rear surface 7*b* of the tip plate. Thereby the fuel and air mixture 60 is directed into the interior of a boiler at an angle of about 60 degrees outward and forward from a center line P of the burner's combustion head 2 when seen from the direction of frame member 5 as illustrated more clearly in FIGS. 3B, 4B and 5B.

In this coordinate system straight to sideways from the longitudinal axis of combustion head is angle 90. Lengthwise direction of combustion head, that is the direction of center line P, is regarded as angle 0.

In a boiler-burner assembly of the invention, nitrogen oxide emissions are principally generated as atmospheric nitrogen is oxidized as a result of high temperature (so-called thermal NOx emissions). It is by lowering the flame temperature in a boiler that NOx emissions can be effectively reduced.

It is by directing the flow 60 of an air-fuel mixture at a correct angle outward as viewed from a longitudinal center line of the burner's 1 combustion head 2 that inside the boiler can be produced a main flame B, which burns at a lower-than-conventional temperature and in which are generated a less-than-usual amount of NOx emissions, cf. also the description of FIGS. 4B and 5B below.

In the invention, the flow 60 of an air-fuel mixture is directed at an angle of about 650 degrees away from a center line P of the combustion head, thereby producing at a tip of the combustion head 2 (behind a plane R defined approximately by the tip plate) a favorable, large-volume main flame B in the shape of a hollow cone. It is a large volume of the main flame B which achieves a low temperature for the main flame and reduces thermal NOx emissions considerably. In addition, the main flame's conical shape enhances return flows internal of the boiler 9, which further expand a volume of the main flame B and reduce NOx emissions.

Figure 4A:
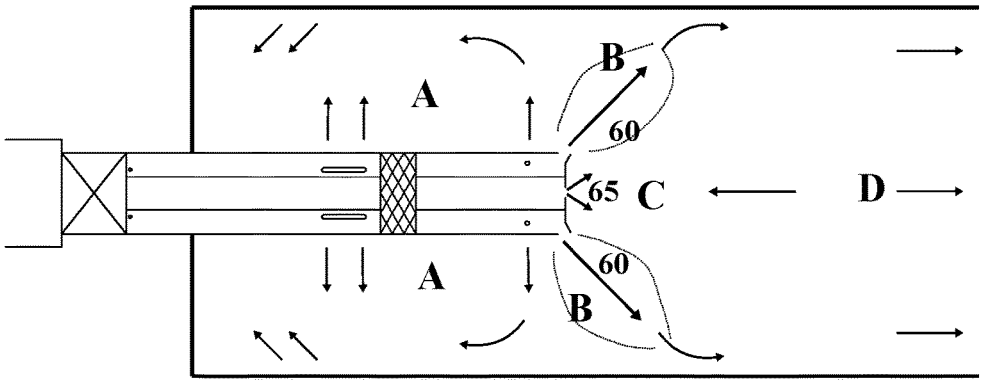
FIG. 4A shows, in a longitudinal section view, a first embodiment for a burner of the invention which is installed to a boiler.

In FIG. 4A is illustrated one embodiment of the invention, wherein the burner 1, visible in FIGS. 3A-3B, is installed by means of a flange 91 to a boiler 9; 9' in which the flue gases discharge from the boiler from behind the tip plate 7 in a view from the frame member 5.

Figure 4B:
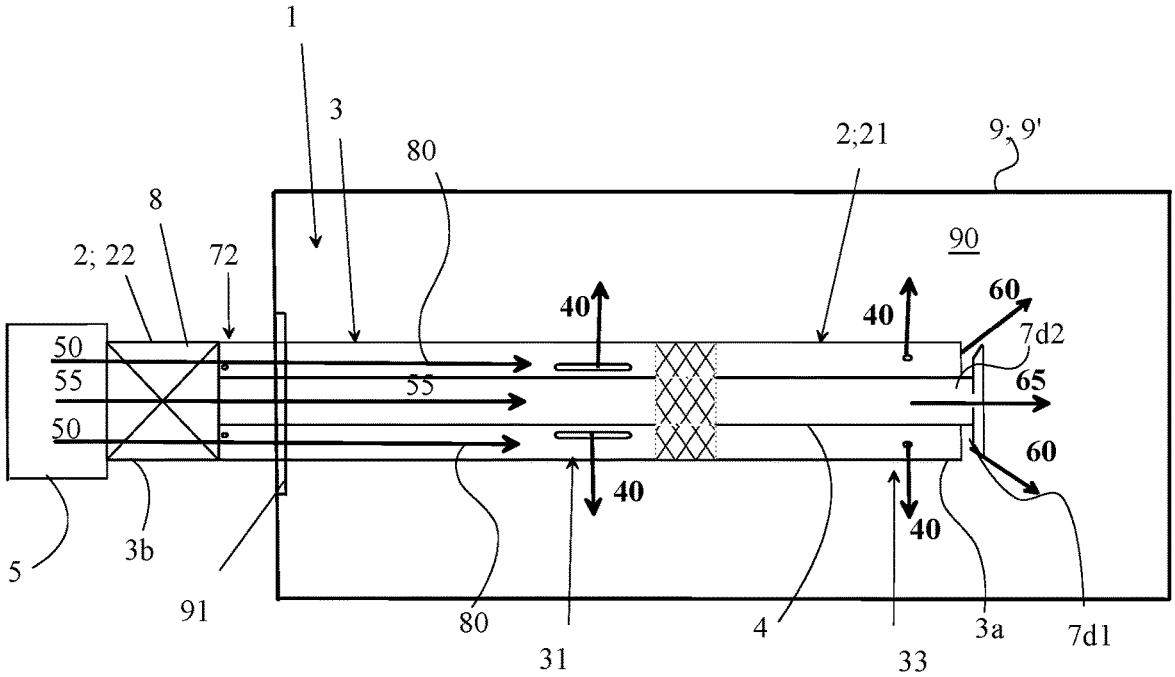
FIG. 4B shows schematically a flame generated in the boiler visible in FIG. 4A and fitted with a burner of the invention.

In FIG. 4B is depicted a flame A, B, C, D generated in such a boiler 9; 9' by means of a burner of the invention. The boiler 9; 9' visible in FIG. 4B has outlet ports for flue gases behind a plane R defined by the combustion head's tip plate as viewed from the burner's frame member 5. In such a boiler there is generated, behind a flame portion C present immediately behind the tip plate 7, a flame portion D whose temperature is higher than that of said flame portion C. Within a zone of the flame portion D, practically all fuel has already burned out completely, but the burning of carbon monoxide emissions (CO emissions) continues. Within the zone of the flame portion D there are generated strong return flows into the flame portion C and thence further into the flame portion B. These return flows enhance the complete burning of carbon monoxide and, in practice, the carbon monoxide emissions in a burner-boiler assembly of the invention are indeed very low, 0-50 ppm, the carbon monoxide emissions of even 0 ppm being attainable with a burner-boiler assembly of the invention.

Figure 5B:
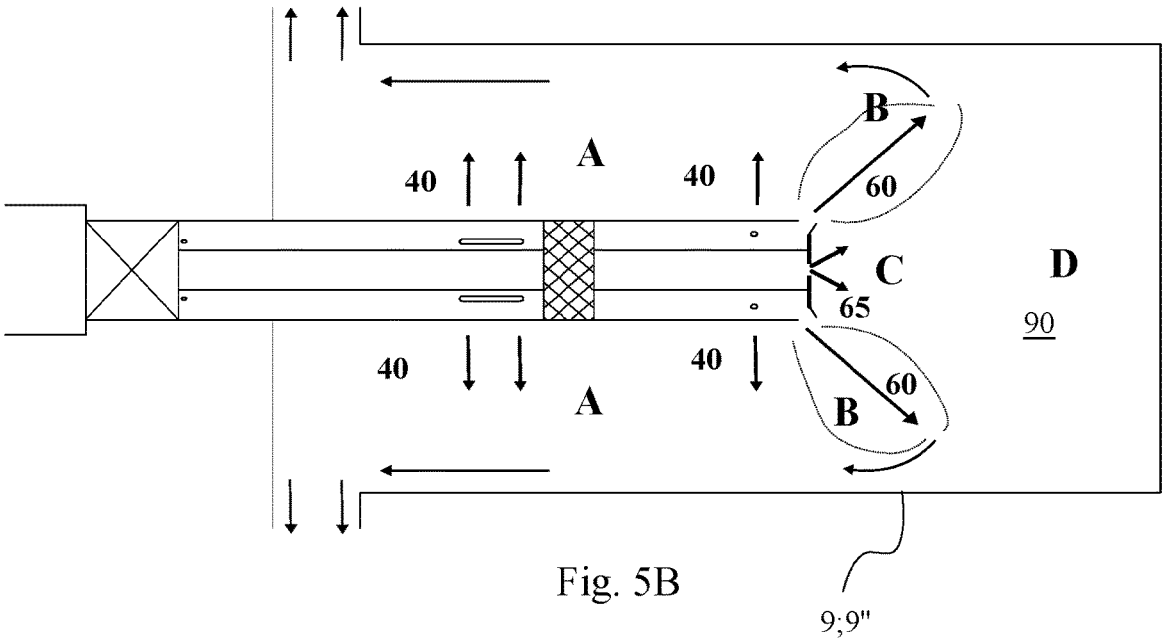
FIG. 5B shows, in a longitudinal section view, a flame generated in the reverse flame boiler-equipped boiler visible in FIG. 5A with a burner of the invention installed thereto.
Figure 5A:
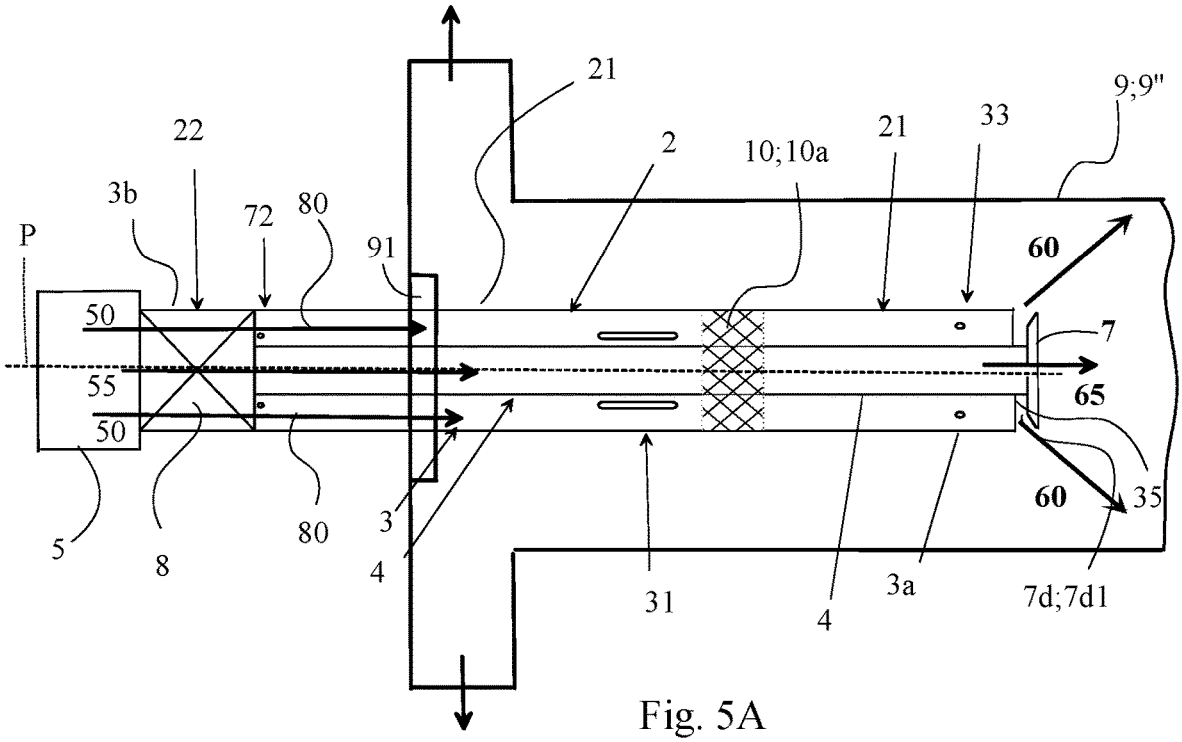
FIG. 5A shows, in a longitudinal section view, a second embodiment for a burner of the invention which is installed to a boiler equipped with a so-called reverse flame boiler.

In FIG. 5A is illustrated another embodiment of the invention, wherein the burner 1, visible in FIGS. 3A-3B, is installed by means of a flange 91 to a boiler 9; 9' in which the flue gases leave the boiler from what in a view from the frame member 5 is a forward side of the tip plate 7 (this is a boiler equipped with a so-called reverse flame boiler). In FIG. 5B is visible a flame A, B, C, D obtainable in such a boiler 9; 9' with a burner of the invention.

The most significant aspects of the invention will now be reviewed in even more detail with reference to the foregoing concise description of FIGS. 1-5.

It is a boiler-burner assembly of the invention, as well as generation of a flame in the interior of a boiler 9, which are illustrated in FIGS. 4A-4B and 5A-5B. FIGS. 1 and 3A reveal a flange 91, which surrounds a combustion head 2 and by means of which the burner's 1 combustion head 2 is coupled to a wall of the boiler 9. In a thereby constructed boiler-burner assembly, the burner 1 comprises a frame member 5, which remains outside the boiler 9 and to which is connected an elongated combustion head 2 protruding from said frame member 5. The combustion head 2 has its first section 22 remaining outside the boiler 9 or being connected to structures of the boiler 9 by means of the flange 91. A section 2; 21 of the combustion head remaining inside the boiler 9 is, in the embodiments of the invention presented in FIGS. 4A and 4B as well as 5A and 5B, similar to what has already been described above.

As mentioned above, it is in a view from the burner's 1 frame member that the opening at a distal end of the outer tube 3, i.e. the opening 35 at a tip 3*a* of the outer tube 3, opens onto a forward side 7*d* of the tip plate 7 into a space 7*d*1. The tip plate 7 is used for spreading a flame, for lowering the temperature of a main flame B obtainable inside the boiler, as well as for generating a flame portion C behind the tip plate.

In order to generate the flame portion C, there is provided from the burner's 1 frame member 5 a supply of inner tube combustion air 55 into the combustion head's 2 inner tube 4 along which the flow of combustion air 55 proceeds by way of said inner tube into what in a view from the burner's 1 frame member 5 is a first space 7*d*2 present on a forward side 7*d* of the tip plate 71 and further through air openings 71 included in the tip plate onto a rearward side of the tip plate. It is by supplying inner tube combustion air 55 through the tip plate 7 into an interior 90 of the boiler 9 by way of the inner tube 4 that immediately on a rearward side 7*e* of the tip plate is produced a flame portion C, which is adjacent to the conical main flame B on each side thereof.

The flame portion C has a temperature lower than that of the main flame B, whereby the flame portion C cools down the main flame B and, in addition, the flame portion C cools down the tip plate 7 and an air duct extending inside the tube 4 present therebelow. The cooling of an air duct present inside the tube 4 enables for example electrical wiring to be brought inside the tube 4. Temperature of the flame portion C behind the tip plate 7 depends on boiler dimensions, whereby the flame portion C may typically have immediately behind the tip plate a temperature which is by way of example 900-1200° C., depending nevertheless significantly on the shape and volume of the actual boiler. The flame portion C generated in the interior 90 of this boiler 9 has a temperature which is lower than that of the main flame B surrounding the same.

The outer tube 3 is provided with a outer tube combustion air 50. From the burner's 1 frame member 5 arrives outer tube combustion air 50, which is premixed with a mixer 8 and then the mixed outer tube combustion air 50 is supplemented with a fuel by way of an aperture line 72 intended for fuel (cf. FIGS. 3A, 4A, 5A). The apertures of said aperture line 72 encircle the outer tube 3 at a short distance from the mixer 8 in a lengthwise direction P of the combustion head 2. The premixed air-fuel mixture 80 produced thereby proceeds further towards what in a view from the frame member is a distal end 3*a* of the outer tube 3. The premixed air-fuel mixture 80 finds its way outside of the combustion head 2 by way of apertures of the aperture lines 31, 33 included in a body of the outer tube 3, as well as by way of a mouth (tip opening) 35 of the outer tube 3, which mouth opens into a space 7*d*1 present on a forward side 7*d* of the tip plate 7 and defined by a front surface 7*c* and a side edge 7*a* of the tip plate 7. The space 7*d*1 is defined in a lengthwise direction of the combustion head 2 by an outer surface of the inner tube 4 and into said space opens the outer tube's mouth 35. The space 7*d*1 opens in a direction away from the combustion head's 2 center line.

The combustion head 2 has its tip plate 71 located at such a distance from the outer tube's 3 mouth 35 that the gaseous mixture 80 of air and fuel arriving in the space 7*d*1 on a forward side 7*d* of the tip plate 7 has a flow connection from the space 7*d*1 of the tip plate's 71 forward side 7*d* into an interior 90 of the boiler 9.

As seen from FIGS. 3A, 3B 4A and 5A, between the tip plate's 7 side edge 7*a* and the tip plate's rear surface 7*b* (or a plane R defined by the tip plate) is an oblique angle of incidence a. The angle of incidence a is about 40-80 degrees, especially about 60 degrees, when viewing the tip plate 7 from where the burner's 1 frame member is located. Preferably, the angle of incidence is about 60 degrees in a view of the tip plate from the burner's frame member 5. This angle of incidence a between the side edge and the tip plate's plane R has such a result that the tip plate's side edge 7*a* directs the air-fuel mixture 80, supplied into the space 7*d*1 on a forward side 7*d* of the tip plate 7, to proceed along said side edge 7*a*, whereby the air-fuel mixture 80 has its stream 60 directed away from the combustion head's longitudinal center line P, as well as at what in a view from the frame member 5 is an angle of about 40-80 degrees, at the same angle of about 60 degrees, away and forward when viewed from the combustion head's 2 longitudinal center line P and frame member 5. The coordination system is the same as mentioned before.

It is such a stream 60 of the air-fuel mixture 80 that contributes to the main flame B being conical in shape and having an extensive burning zone. It is by virtue of a large extent of the conical burning zone that achieves a large burning volume and a low power density. A low power density leads to a low burning temperature and thereby to low NOx emissions. It is a conical shape of the main flame B around the tip of the combustion head 2 that also enhances return flows which stabilize the main flame B and blend flue gases into the main flame B, which further expands the conical burning zone and thereby lowers the burning temperature within the main flame zone.

The main flame B is stabilized partially by a flame portion C generated on a rearward side of the tip plate C, but mostly the main flame B is stabilized by using a flame portion A, which is to be developed around the combustion head 2 and is contiguous to the main flame (cf. FIGS. 4B and 5B). In order to generate proper type of return flows of flue gases, the combustion head 2 has its outer tube 3 preferably formed with a first plurality of apertures consisting of apertures with a circular cross-section, said plurality of apertures being made up of an aperture line 33, the apertures included therein encircling a body 30 of the outer tube 3 at an equal first distance from what in a view from the burner's frame member 5 is its distal end 3*a* (cf. FIGS. 3A, 3C, 4A, 4B, 5A, 5B).

The combustion head 2 has its outer tube 3 also formed with a second plurality of apertures consisting of an aperture line 31, the apertures included therein encircling the outer tube 3 in its mid-section or central region at an equal second distance from what in a view from the burner's frame member 5 is distal end 3*a* of the outer tube 3.

Preferably, the first aperture line 33 has its apertures located closer to the combustion head's 2 tip than the apertures of the second aperture line 31.

The apertures of the second aperture line 31 are apertures with an elongated cross section, such as apertures with oblong, oval or ellipse-shaped cross-sections extending through a body 30 of the outer tube 3. The gas flow directed from the frame 5 into the outer tube 3, and further to an end 3*a* of the tube, such as a stream 40 of the air-fuel mixture 80, proceeds through the apertures of both the aperture line 31 and the aperture line 33. The stream 40 of the air-fuel mixture 80 passing through the apertures has its rate through the apertures of the aperture lines 31, 33 depending, among others, on a flow rate of the stream 40 of the air-fuel mixture 80, as well as on the size of the apertures in the aperture lines 31, 33.

As seen from FIGS. 4A and 5A, the fuel-air mixture 80 discharges by way of the aperture lines 31 and 33 in the form of a stream 40 whose direction is at an angle of about 90 degrees with respect to a longitudinal center line P of the combustion head 2, thereby generating a flame portion A around the combustion head 2. Around the combustion head 2 there is a lot of swirling and flue gas return flows. When this area is supplied from the apertures of the aperture lines 31, 33 with an air-fuel mixture as the gas stream 40, the latter, as it is burning, generates a flame portion A which increases temperature in the vicinity of the combustion head and stabilizes the main flame B adjoined by the flame portion A. The temperature of this flame portion is strongly dependent e.g. on the diameter of a boiler 9 and, in a larger boiler, among other things, the flame portion A has a larger burning zone and the flue gas return flows have a larger mass flow rate. As already pointed out earlier, adjusting the size of apertures included in the aperture line 31 consisting of elongated apertures is enabled by means of mechanical adjustment elements 10; 10*a*, thereby enabling temperature of the flame portion A to be adjusted appropriately for each boiler type.

In the boiler-burner assembly presented in FIG. 5B, the boiler 9; 9", a so-called reverse flame boiler, has outlet ports for flue gases located behind what in a view from the burner's 1 frame member 5 is a plane R defined by the combustion head's 2 tip plate 7. This type of boiler develops a basically similar main flame B, a flame portion C present behind the tip plate, and a flame portion A which surrounds the combustion head and raises temperature in the combustion head's vicinity and stabilizes the main flame B, whereby the flame portion A is delimited the same way as in the boiler-burner assembly of FIGS. 4A-4B. In this case, however, the return flow of flue gases from the main flame B diverts towards the outlet ports for flue gases, whereby the main flame is generally smaller. The flame portion D does not have much significance in this type of boiler-burner assembly.

It is obvious for a person skilled in the art that the present invention can be implemented in a variety of other ways as well. Accordingly, in FIGS. 6A and 6B are illustrated a few optional implementations for a burner of the invention.

Figure 6A:
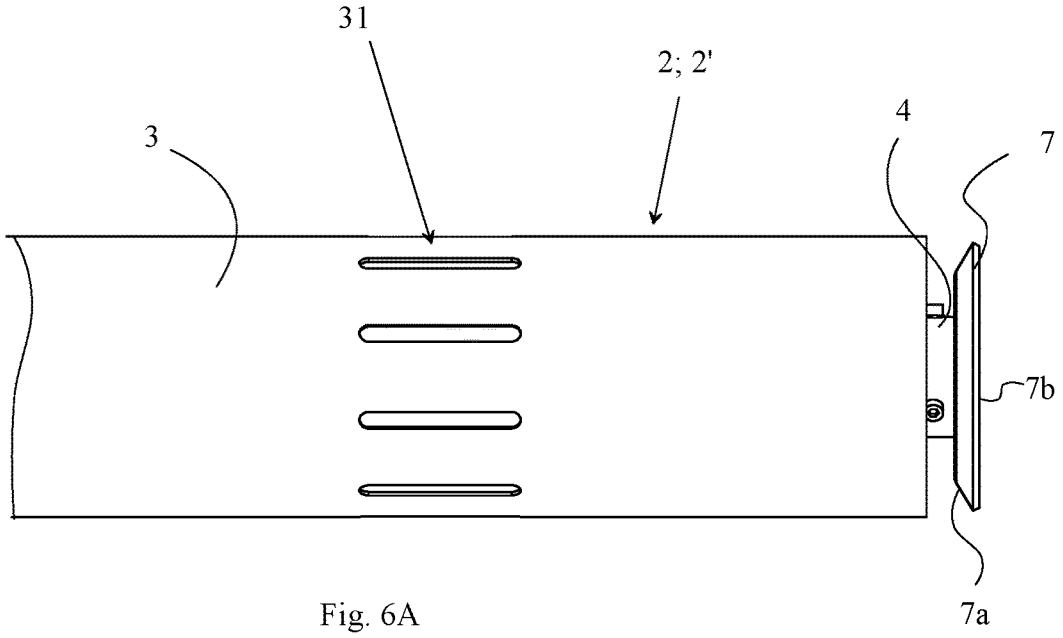
FIG. 6A shows, in a direct side view, a combustion head for a burner according to a second embodiment of the invention, having its frame provided with an aperture pattern which is slightly different from those in the combustion heads of burners visible in FIGS. 1-5.

FIG. 6A reveals one optional construction of a combustion head 2; 2' for a burner 1 of the invention. This combustion head 2; 2' is provided with a tip plate similar to that included in the burner 1 shown in FIGS. 1-5, but in this case the outer tube 3 is only formed with a single plurality of apertures, which consists of an aperture line 31, the apertures included therein being apertures with elongated, oblong, such as oval or ellipse-shaped, cross-sections. This aperture line encircles a body 30 of the outer tube 3 approximately in a mid-section of the body. It is also possible to provide this way a boiler-burner assembly, in which the main flame B has a volume which is comparatively large.

Figure 6B:
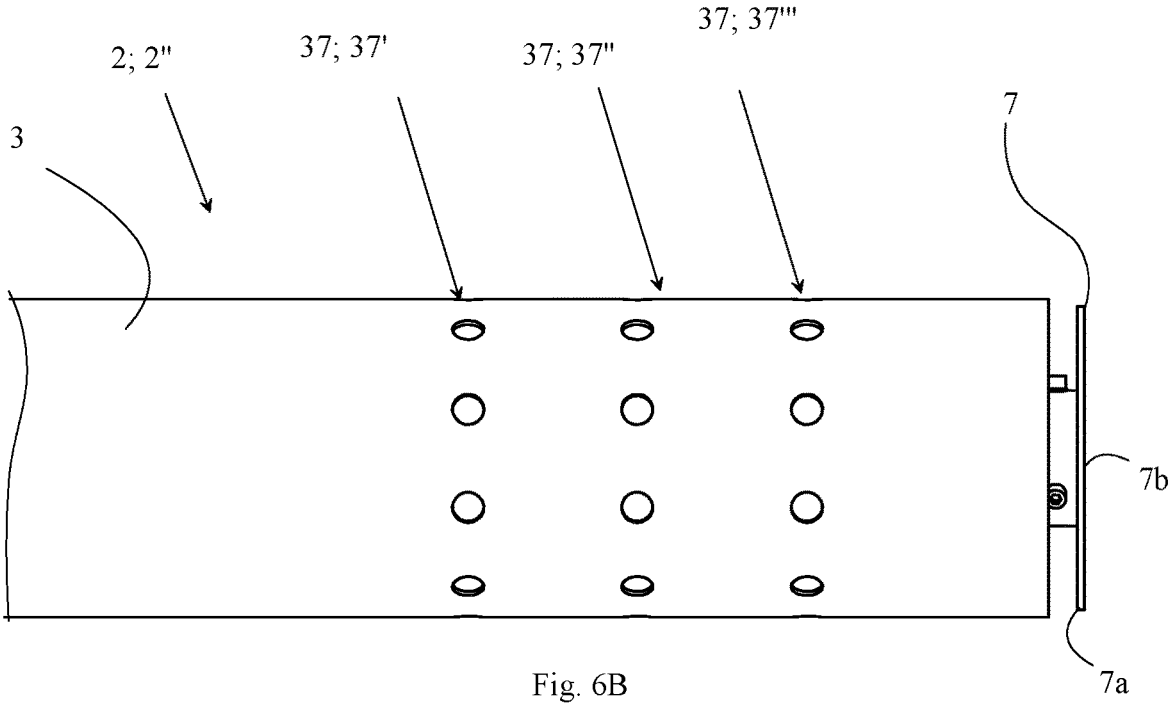
FIG. 6B shows, in a direct side view, a combustion head for a burner according to yet another embodiment of the invention, its tip plate having an edge which is right-angled and its frame having an aperture pattern which is slightly further different from that used in the combustion head of burners shown in FIGS. 1-5, 6A.

FIG. 6B reveals another possible construction of a combustion head 2; 2" for a burner 1 of the invention, which provides a few benefits of a burner according to the invention. In the combustion head 2; 2" of FIG. 6B, the virtual angle of incidence a, formed by a side edge 7*a* of the tip plate 71 with a plane R defined by the tip plate, is co-directional with a center line P of the combustion head 2. Hence, the air-fuel mixture discharging from a tip 3*a* of the outer tube 3 is directed at an angle of 90 degrees away from the longitudinal center line P of the combustion head 2. In addition, the combustion head 2 has its outer tube 3 formed with three successive arrays of apertures, each of said arrays of apertures consisting of an aperture line 37; 37', 37", 37''', the apertures included therein being circular in cross-section and each aperture line encircling the outer tube 3 preferably in a mid-section of its body.

Figure 7:
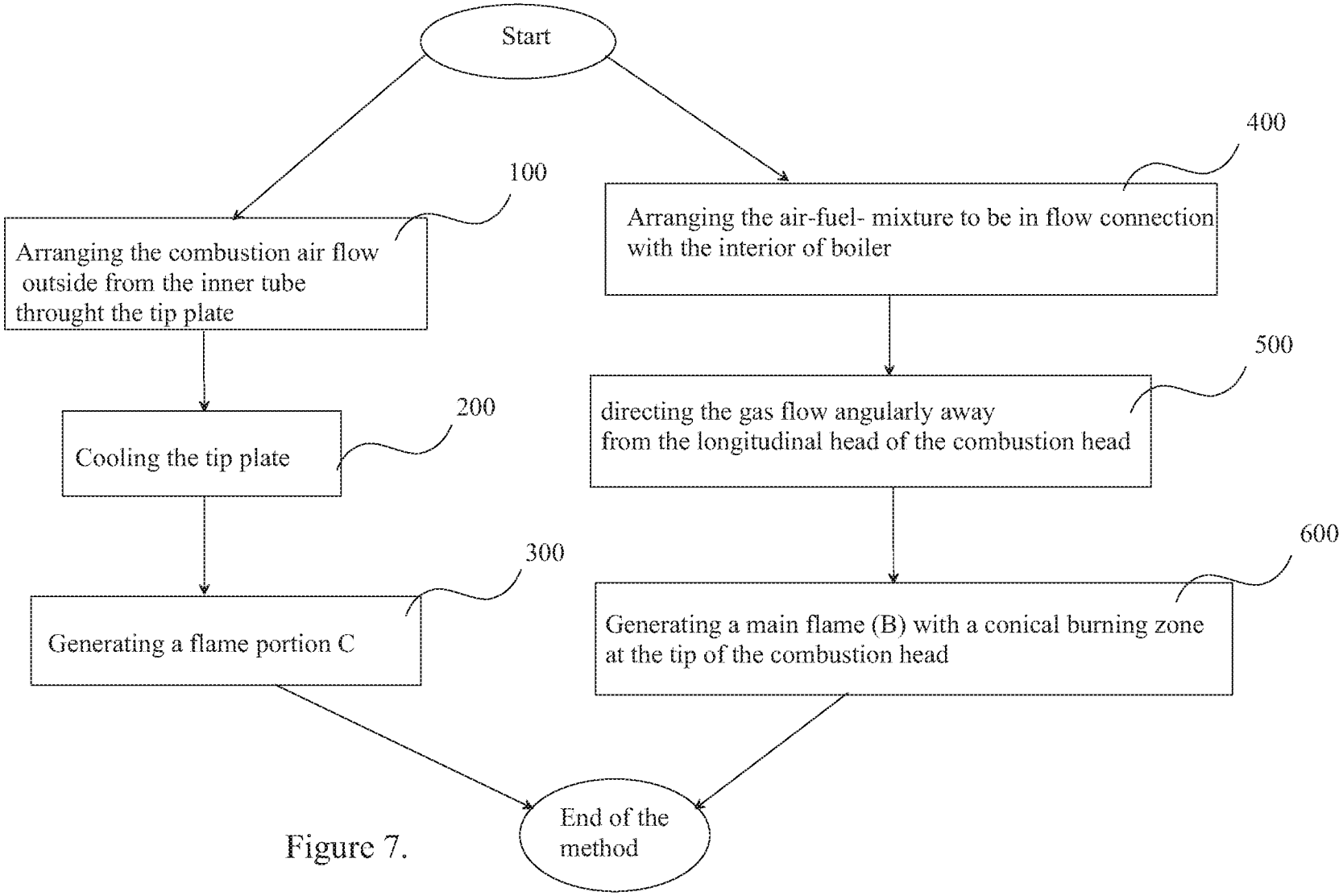
FIG. 7 shows schematically the general layout of the method for generating a flame inside the boiler. Aspects of a burner, as well as a boiler-burner assembly, of the invention illustrated in FIGS. 1-6 will be briefly reviewed hereinafter by describing structural and functional details visible in the figures for a burner of the invention.

FIG. 7 shows schematically the method steps for generating a flame (A, B, C, D) inside of a boiler (9). Said boiler has been combined to ta burner of the present invention shown specifically in FIGS. 1-5.

These method steps comprise following:

arranging the combustion air (55) to flow from the combustion head's (2) inner tube (4) to a forward side (7*d*) of the tip plate (71) and further through air openings (71) included in the tip plate (step 100);

cooling the tip plate (step 200);

generating a flame portion (C) inside (90) the boiler (9) (Step 300). This flame portion locates immediately behind the tip plate (71), and have a temperature which is lower than the temperature of a main flame (B) surrounding the flame portion C, arranging the gas, supplied in a space (7*d*1) on a forward side (7*d*) of the tip plate (7) to be in a flow connection with the interior (90) of the boiler (9) (step 400);

directing the gas flow angularly away from a longitudinal center line (P) of the combustion head (2) (step 500);

generating a main flame (B) which surrounds said flame portion (C), said main flame (B) having a conical burning zone at a tip of the combustion head (2) (step 600).

REFERENCE ENUMERATION

Burner 1
Combustion head 2
section remaining inside boiler 21
section remaining outside boiler 22
Larger diameter tube, outer tube 3
body 30
line of elongated apertures 31
line of first apertures 33
line/lines of second aperture/apertures 37
distal end of the tube, tip of the tube 3*a*
mouth, tip opening 35
proximal end of the tube 3*b*
Inner tube, smaller diameter tube 4
Frame member of the burner 5
Tip plate 7
side edge 7*a*
rear surface 7*b*
front surface 7*c*
forward side 7*d*
spaces on forward side 7*d*1, 7*d*2
rearward side 7*e*
air opening 71
line of openings for fuel 72
Mixing device 8
Boiler 9
interior 90
Flange for a joint between boiler and burner 91
Mechanical adjustment elements 10
Stream of premixed air-fuel mixture (into boiler) 40
Supply of outer tube combustion air 50
Supply of inner tube combustion air 55
Stream of gas mixture from a side of the tip plate (into boiler) 60
Flow of combustion air through the tip plate (into boiler) 65
Premixed air-fuel mixture 80
Method steps 100-600
Flame A, B, C, D
side flame around the combustion head A
main flame B
side flame immediately behind the tip plate C
more distant side flame behind the tip plate D
Angle between a side edge 7*a* and a plane R of the tip plate a
Supplied air I
Lengthwise direction of the combustion head P
Plane defined by the tip plate R
Width of the tip plate T

The invention claimed is:

1. A burner installable to a boiler (9) for burning a premixed air-fuel mixture, said burner (1) comprising a frame member (5) provided with an elongated combustion head (2) protruding from the frame member and having what in a view from the frame member is its distal end provided with a tip plate (7), said combustion head (2) comprising an outer, larger diameter tube (3) for a mixture of combustion air and fuel, as well as an inner, smaller diameter tube (4) for combustion air, whereby the combustion head (2) has its outer tube (3) formed with at least one array of aperture lines (31, 33) encircling said body (30) of the outer tube (3) and, in addition, what in a view from the burner's (1) frame member is a distal end opening of the outer tube, i.e. an opening (35) at a tip (3*a*) of the outer tube (3), opens to below the tip plate (7), said outer tube (3) being provided with a supply of premixed air-fuel mixture (80) for conveying the premixed air-fuel mixture (80) outward of the combustion head (2) by way of the apertures (31, 33) included in the body of the outer tube (3), as well as by way of the outer tube's tip opening, and the inner tube (4) of the combustion head (2) is continuous and extends from the frame member (5) forward of the tip plate, said tip plate (7) having a width (T) substantially equal to the diameter of the outer tube's (3) tip opening (35) and the direction of a plane (R) defined by the tip plate (7) is transverse to a longitudinal direction (P) of the combustion head, characterized in that between a side edge (7*a*) of the tip plate (7) and the plane (R) of the tip plate (7) is an oblique angle of incidence (a) for directing a gas (30) delivered forward of the tip plate (7) away from the longitudinal center axis (P) of the combustion head (2), the combustion head (2) has its tip plate (7) provided with a plurality of air openings (71) extending through the tip plate (8) and it is for cooling the tip plate (7) that the inner tube (4) is additionally provided with a supply of combustion air (55) for conveying the combustion air through the tip plate's air openings (71), and the mouth of the inner tube (4) opens into a space (7*d*2) present on what in the combustion air traveling direction is a forward side (7) of the tip plate (7), and into alignment with the air openings (71) of the tip plate (7).

2. A burner (1) according to claim 1, characterized in that the combustion air (55) is adapted to flow from the burner's frame member (5) through the inner tube (4) and further along the inner tube (4), extending to what in a view from the burner's frame member 5 is a front surface (7*c*) of the tip plate (9), into a space (7*d*2) present on a forward side (7*d*) of the tip plate (7), and further through the air openings (71) of the tip plate (7) over to a rearward side (7*e*) of the tip plate (7).

3. A burner (1) according to any of the preceding claims, characterized in that the combustion head (2) has its tip plate (7) disposed at such a distance from the mouth (35) of the outer tube (3) that the gas mixture (80), arriving by way of the outer tube in a space (7*d*1) present on a forward side (7*d*) of the tip plate's (7) front surface (7*c*), is able to flow from the space (7*d*1) on the tip plate's (7) forward side (7*d*) into an interior (90) of the boiler (9).

4. A burner (1) according to any of the preceding claims, characterized in that the inner tube (4) has its mouth adapted to open into a first space (7*d*2) on the tip plate's forward side (7*d*) and the outer tube (3) has its mouth adapted to open into a second space (7*d*2) onto the tip plate's forward side (7*d*), whereby the blending of gas mixtures arriving in said spaces (7*d*1, 7*d*2) on the tip plate's forward side (7*d*) is prevented by means of an outer surface of the inner tube (4).

5. A burner (1) according to claim 1, characterized in that the combustion head (2) has its outer tube (3) formed with a first plurality of apertures, for example apertures with a circular cross-section, said plurality of apertures being made up of an aperture line (33), the apertures included therein encircling the outer tube close to what in a view from the burner's frame member (5) is its distal end (3*a*) and, in addition, the combustion head (2) is formed with a second plurality of apertures, which are apertures with an elongated cross-section, such as apertures with oval or ellipse-shaped cross-sections, said second plurality of apertures being made up of an aperture line (31), the apertures included therein encircling the outer tube (3) further away from what in a view from the burner's frame member (5) is its distal end (3*a*), preferably in a midsection or central region of the tube.

6. A burner (1) according to any of the preceding claims, characterized in that the combustion head (2) is further provided in connection with its outer tube (3) with mechanical adjustment elements (10) for adjusting the opening size of the apertures (31, 33) included in walls of the outer tube (3).

7. A burner (1) according to claim 6, characterized in that the mechanical adjustment elements (10) comprise a flange member, such as a collar, which is present on an internal surface of the outer tube and which is displaceable to cover partially or completely the apertures of the elongated aperture line (31).

8. A burner (1) according to claim 1, characterized in that the virtual angle of incidence (a) formed by a side edge of the tip plate (71) with a plane (R) defined by the tip plate is co-directional with a center line (P) of the combustion head (2), whereby the air-fuel mixture discharging from a tip (3*a*) of the outer tube (3) is directed at an angle of 90 degrees away from the longitudinal center line (P) of the combustion head (2).

9. A burner (1) according to claim 8, characterized in that the combustion head (2) has its outer tube (3) formed with three successive arrays of apertures, each of said arrays of apertures consisting of an aperture line (37; 37', 37'', 37'''), the apertures included therein being preferably circular in cross-section and each aperture line encircling the outer tube (3) preferably in a mid-section of its body.

10. A burner (1) according to claim 1, characterized in that the tip plate (7) has its side edge (7*a*) at an angle of about 40-80 degrees, especially at an angle of 60 degrees, with a plane (R) defined by the tip plate (7) as the tip plate is viewed from where the burner's (1) frame member (5) is located.

11. A burner (1) according to claim 10, characterized in that the combustion head (2) has its outer tube (3) formed with a single plurality of apertures, which is made up of an aperture line (31), the apertures included therein being elongated in cross-section, such as oval or ellipse-shaped, said aperture line encircling a body (30) of the outer tube (3) in its mid-section.

12. A burner (1) according to claim 1, characterized in that the inner tube (4) has electric wires extending in its interior.

13. A boiler-burner assembly for burning a premixed air-fuel mixture (80) with a flame (A, B, C, D) generated inside (90) a boiler (9), said burner (1) comprising a frame member (5) remaining outside the boiler (9) and having associated therewith an elongated combustion head (2) protruding from said frame member (5) and having a first section (22) thereof remaining outside the boiler (9) or being connected to structures of the boiler (9) and having a second section (21) thereof extending into an interior of the boiler (9), and said combustion head (2) having what in a view from the frame member (5) of the burner (1) is its distal end provided with a tip plate (7), said combustion head (2) comprising an outer, larger diameter tube (3) for a mixture of combustion air and fuel as well as an inner, smaller diameter tube (4), whereby the combustion head (2) has its outer tube (3) formed with at least one array of aperture lines (31, 33) encircling said body of the outer tube (3) and, in addition, what in a view from the burner's (1) frame member is a distal end opening of the outer tube (3), i.e. an opening (35) at a tip (3*a*) of the outer tube (3), opens into a space (7*d*1) on a forward side (7*d*) of the tip plate (7), said outer tube (3) being provided with a supply of premixed air-fuel mixture (80) preferably from the burner's frame member (5) for conveying the premixed air-fuel mixture (80) outward of the combustion head (2) by way of the apertures (31, 33) included in the body of the outer tube (3), as well as by way of the outer tube's tip opening (35), and the inner tube (4) of the combustion head (2) is continuous and extends from the frame member (5) into a space (7*d*2) on a forward side (7*d*) of the tip plate (7), said tip plate (7) having a width (T) approximately equal to the diameter of the outer tube's (3) tip opening (35) and the direction of a plane (R) defined by the tip plate (7) is transverse to a longitudinal direction (P) of the combustion head (2), wherein the mouth of the inner tube (4) opens into the space (7*d*2) present on what in the combustion air traveling direction is a forward side (7) of the tip plate (7), and into alignment with the air openings (71) of the tip plate (7), characterized in that from the burner's (1) frame member (5) is provided a supply of combustion air (55) into the combustion head's (2) inner tube (4) for conveying the combustion air (55) by way of said inner tube to what in a view from the burner's (1) frame member (5) is a forward side (7*d*) of the tip plate (71) and further through air openings (71) included in the tip plate for cooling said tip plate, whereby the temperature of a flame portion (C) generated inside (90) the boiler (9), which temperature is established in the boiler interior (90) immediately behind the tip plate (71), is lower than the temperature of a main flame (B) surrounding the same, the combustion head (2) has its tip plate (71) located at such a distance from the outer tube's (3) mouth (35) that the gas, such as the fuel-air mixture (80), arriving in a space (7*d*1) on a forward side (7*d*) of the tip plate (7) has a flow connection from the space (7*d*1) on the forward side (7*d*) of the tip plate (71) into an interior (90) of the boiler (9) and, in addition, between a side edge (7*a*) of the tip plate (7) and a plane (R) defined by the tip plate (7) is an angle of incidence (a) as a result of which the gas (30) supplied to the forward side of the tip plate (7) is directed angularly away from a longitudinal center line (P) of the combustion head (2), generating a main flame (B) which surrounds said flame portion (C).

14. A boiler-burner assembly according to claim 13, characterized in that between a side edge (7*a*) of the tip plate (7) and a rear surface (7*b*) of the tip plate (7) is an angle of incidence (a), which is about 40-80 degrees, especially about 60 degrees, as the tip plate (7) is viewed from where the burner's (1) frame member is located, for directing a stream (60) of air-fuel mixture (80), discharging from a mouth (35) of the outer tube (3), away from a longitudinal center line (P) of the combustion head respectively at an angle of about 40-80 degrees, especially at an angle of about 60 degrees, as the stream is viewed from the direction of the burner's frame member.

15. A boiler-burner assembly according to claim 13 or 14, characterized in that the steam (60) of premixed air-fuel mixture (80), provided from the burner's (1) frame member (5) by way of the combustion head's (2) outer tube (3) into an interior (90) of the boiler (9), generates in the interior (90) of the boiler (9) a main flame (B) in which the burning of fuel takes place in a conical burning zone at a tip of the combustion head (2).

16. A boiler-burner assembly according to claim 13, characterized in that a flow (40) of fuel-air mixture (80) is further provided by way of the apertures of aperture lines (31, 33) to generate a flame portion (A), which surrounds the combustion head (2) and is contiguous to the main flame (B), thereby stabilizing said main flame (B).

17. A boiler-burner assembly according to claim 16, characterized in that the temperature and burning zone of the flame portion (A) can be varied by varying the diameter of apertures included in the aperture lines (31, 33, 37).

18. A boiler-burner assembly according to claim 13, characterized in that the boiler (9) is provided with outlet ports for flue gases on what in a view from the burner's (1) frame member (5) is a rearward side of a plane (R) defined by the combustion head's (2) tip plate (7).

19. A boiler-burner assembly according to claim 18, characterized in that behind the flame portion C is generated a flame portion D whose temperature is lower than the temperature of flame portion B (main flame).

20. A boiler-burner assembly according to claim 13, characterized in that the combustion head (2) has its outer tube (3) formed with several aperture lines (31, 33, 37), which encircle the outer tube, and one aperture line from among said aperture lines is made up of elongated apertures with adjustable diameters.

21. A boiler-burner assembly according to claim 20, characterized in that the flue gases discharge from the boiler (9) from what in a view from the burner's (1) frame member (5) is a forward side of the plane (R) defined by the combustion head's tip plate (7).

22. A method for generating a flame (A, B, C, D) inside of a boiler (9) of the boiler-burner assembly by burning a premixed air-fuel mixture (80) with a flame (A, B, C, D), wherein said burner (1) comprising a frame member (5) remaining outside the boiler (9) and having associated therewith an elongated combustion head (2) protruding from said frame member (5) and having a first section (22) thereof remaining outside the boiler (9) or being connected to structures of the boiler (9) and having a second section (21) thereof extending into an interior of combustion space of the boiler (9), and said combustion head (2) provided its distal end with a tip plate (7), said combustion head (2) comprising an outer, larger diameter tube (3) for a mixture of combustion air and fuel as well as an inner, smaller diameter tube (4), whereby the combustion head (2) has its outer tube (3) formed with at least one array of aperture lines (31, 33) encircling said body of the outer tube (3) and, in addition, an opening (35) at a tip (3*a*) of the outer tube (3), opens into a space (7*d*1) on a forward side (7*d*) of the tip plate (7), said outer tube (3) being provided with a supply of premixed air-fuel mixture (80) for conveying the premixed air-fuel mixture (80) outward of the combustion head (2) by way of the apertures (31, 33) included in the body of the outer tube (3), as well as by way of the outer tube's tip opening (35), and the inner tube (4) of the combustion head (2) is continuous and extends from the frame member (5) into a space (7*d*2) on a forward side (7*d*) of the tip plate (7), said tip plate (7) having a width (T) approximately equal to the diameter of the outer tube's (3) tip opening (35) and the direction of a plane (R) defined by the tip plate (7) is transverse to a longitudinal direction (P) of the combustion head (2), wherein the mouth of the inner tube (4) opens into the space (7*d*2) present on what in the combustion air traveling direction is a forward side (7) of the tip plate (7), and into alignment with the air openings (71) of the tip plate (7), characterized in that said method comprises at least following steps:

arranging the combustion air (55) to flow from the combustion head's (2) inner tube (4) to a forward side (7*d*) of the tip plate (71) and further through air openings (71) included in the tip plate to cool said tip plate and to generate a flame portion (C) inside (90) the boiler (9), immediately behind the tip plate (71), said flame portion (C) having a temperature which is lower than the temperature of a main flame (B) surrounding the flame portion (C), arranging the gas, such as the fuel-air mixture (80), supplied in a space (7*d*1) on a forward side (7*d*) of the tip plate (7) to be in a flow connection from the space (7*d*1) on the forward side (7*d*) of the tip plate (71) into an interior (90) of the boiler (9)

directing the gas flow angularly away from a longitudinal center line (P) of the combustion head (2) by means of an angle of incidence between a side edge (7*a*) of the tip plate (7) and a plane (R) defined by the tip plate (7) thus generating a main flame (B) which surrounds said flame portion (C), said main flame (B) having a conical burning zone at a tip of the combustion head (2).

23. The method defined in claim 22, characterized in that the angle of incidence (a), is about 40-80 degrees, especially about 60 degrees, for directing a stream (60) of air-fuel mixture (80), discharging from a mouth (35) of the outer tube (3), away from a longitudinal center line (P) of the combustion head respectively at an angle of about 40-80 degrees, especially at an angle of about 60 degrees, as the stream is viewed from the direction of burner's frame member.

24. The method defined in claim 22, characterized in that the fuel-air mixture (80) is adapted to flow via apertures of aperture lines (31, 33) to generate a flame portion (A), which surrounds the combustion head (2) and is contiguous to the main flame (B), thereby stabilizing said main flame (B).

25. The method defined in claim 24, characterized in that the temperature and burning zone of the flame portion (A) can be changed by varying the diameter of apertures included in the aperture lines (31, 33, 37).

* * * * *